US005309696A

United States Patent [19]

Heudecker et al.

[11] Patent Number: 5,309,696

[45] Date of Patent: May 10, 1994

[54] APPARATUS FOR TRANSPORTING CLOSING CAPS IN VESSEL CLOSING MACHINES

[75] Inventors: Gerhard Heudecker, Pentling-Poign; Georg Setz, Hauzendorf, both of Fed. Rep. of Germany

[73] Assignee: Krones Ag Hermann Kronseder Maschinenfabrik, Neutraubling, Fed. Rep. of Germany

[21] Appl. No.: 122,183

[22] Filed: Sep. 17, 1993

Related U.S. Application Data

[63] Continuation of Ser. No. 862,713, Apr. 3, 1992, abandoned.

[30] Foreign Application Priority Data

Apr. 5, 1991 [DE] Fed. Rep. of Germany ..... 9104140

[51] Int. Cl.[5] ..... B67B 3/064; B65B 7/28

[52] U.S. Cl. ..... 53/306; 53/308

[58] Field of Search ..... 53/306, 308, 331.5, 53/317, 310, 312, 359, 343, 488, 314, 167

[56] References Cited

U.S. PATENT DOCUMENTS

| | | | |
|---|---|---|---|
| 2,925,797 | 2/1960 | Diezel et al. | 53/308 X |
| 3,600,874 | 8/1971 | Noguchi et al. | 53/306 |
| 3,643,398 | 2/1972 | Quest et al. | 53/306 X |
| 3,683,588 | 8/1972 | Ahlers | 53/308 X |
| 3,777,449 | 12/1973 | Sindermann | 53/306 X |
| 3,807,133 | 4/1974 | Simonazzi | 53/306 |

FOREIGN PATENT DOCUMENTS

| | | |
|---|---|---|
| 2147770 | 3/1972 | Fed. Rep. of Germany . |
| 2734599 | 8/1979 | Fed. Rep. of Germany . |

*Primary Examiner*—Horace M. Culver
*Attorney, Agent, or Firm*—Finnegan, Henderson, Farabow, Garrett & Dunner

[57] ABSTRACT

An apparatus for transporting closing caps in vessel closing machines. In order to eliminate the risk of caps getting crushed and to increase the operating reliability and efficiency, the apparatus is characterized in that the end portion of the conveying duct is directly followed in the direction of movement of the engaging means by a guide channel for guiding the caps, the guide channel comprising guide elements extending at both sides of the path of the engaging means, and that the transporting device is so formed that prior to the arrival of the associated engaging means it transports the respectively foremost cap from the end portion of the conveying duct at least partly between the guide elements and retains it there, if necessary, until the arrival of the engaging means.

14 Claims, 1 Drawing Sheet

APPARATUS FOR TRANSPORTING CLOSING CAPS IN VESSEL CLOSING MACHINES

This application is a continuation of application Ser. No. 07/862,713, filed Apr. 3, 1992, now abandoned.

BACKGROUND OF THE INVENTION

This invention relates to an apparatus for transporting closing caps in vessel closing machines.

An apparatus of this type is already known. In such an apparatus, the engaging means are formed by the beveled teeth of a star-shaped wheel and the transporting device comprises a conveying belt extending radially relative to the rotational axis of the star-shaped wheel (DE-OS 21 47 770). The end portion of the conveying duct is followed by a slide path which extends on the circumference of the star-shaped wheel and comprises a lateral guide strip for the caps. In this known apparatus, caps may easily get crushed between the star-shaped wheel and the beginning of the guide strip when the conveying belt does not supply the caps fast enough. The operating reliability is therefore small; the achievable efficiency limited.

In another known apparatus of the above-mentioned type, the engaging means are formed by radially projecting cams of a round disc, and the transporting device includes a magnet which is arranged opposite to the end portion of the conveying duct and comprises a stop limiting the penetration depth of the caps into the curved path of the engaging means (DE-OS 27 34 599). The caps which are pulled away by the engaging means from the stop are first exclusively fixed by other magnets onto the disc before they are gripped by the stationary guide strip of a slide path formed along the circumference of the disc for the caps. Deformed corks are to be removed through the resultant gap between the end portion of the conveying duct and the initial area of the guide strip. In this case, too, it may happen that corks get crushed between the engaging means and the front edge of the guide strip, as these can be guided by the magnets in an inadequate way only.

In both of the known apparatuses, the closing heads which are provided with holding magnets for the caps are indirectly supplied with caps, i.e. the star-shaped wheel or the disc and the stationary slide paths and guide strips are interposed. This results in a complicated structure.

It is the object of the invention to eliminate the risk of caps getting crushed in a generic apparatus used for transporting closing caps, and to increase the operating reliability and efficiency thereby. Furthermore, it should be possible to feed closing heads directly with caps.

SUMMARY OF THE INVENTION

In an apparatus according to the invention, the closing caps are already seated between the guide elements of the guide channel at the moment when they are engaged by the engaging means, and can thus no longer escape laterally or get jammed and possibly crushed. The distance between the outlet of the conveying duct and the guide channel is extremely short and can therefore be covered rapidly enough even at maximum outputs. The engaging means can strike against the closing caps at a very high rate. The achievable efficiency is thus correspondingly high. At average or high outputs, the closing caps can hardly rest before the attack of the respective engaging means. At small outputs, the closing caps must possibly be held between the guide elements for a short period of time until the respective engaging means arrives.

Furthermore, it is especially advantageous when, the respective cap which is waiting for its engaging means serves as a stop for the next cap at the same time. This permits an especially simple construction.

There are various possibilities of constructing the transporting device. This device may, e.g., be formed by a small rotary disc on which the caps rest. A design of the transporting device with magnets, is especially advantageous. This permits, on the one hand, an especially reliable transportation of the caps, which must be magnetically controllable, and, on the other hand, an especially compact structure which can be easily cleaned.

The engaging means may, e.g., be formed by the radially projecting teeth of a star-shaped wheel which supplies the caps to the rotating closing heads of the vessel closing machine. In an especially expedient embodiment, the engaging means are cam-shaped or pin-shaped and directly arranged on the surrounding closing heads of the vessel closing machine. As a result, a rotating star-shaped wheel, or the like, can be dispensed with. This is made possible by the exact initial guidance of the caps between the guide elements.

BRIEF DESCRIPTION OF THE DRAWINGS

Two embodiments of the invention shall now be described with reference to the drawings, in which.

DETAILED DESCRIPTION OF THE INVENTION

Figure 1:
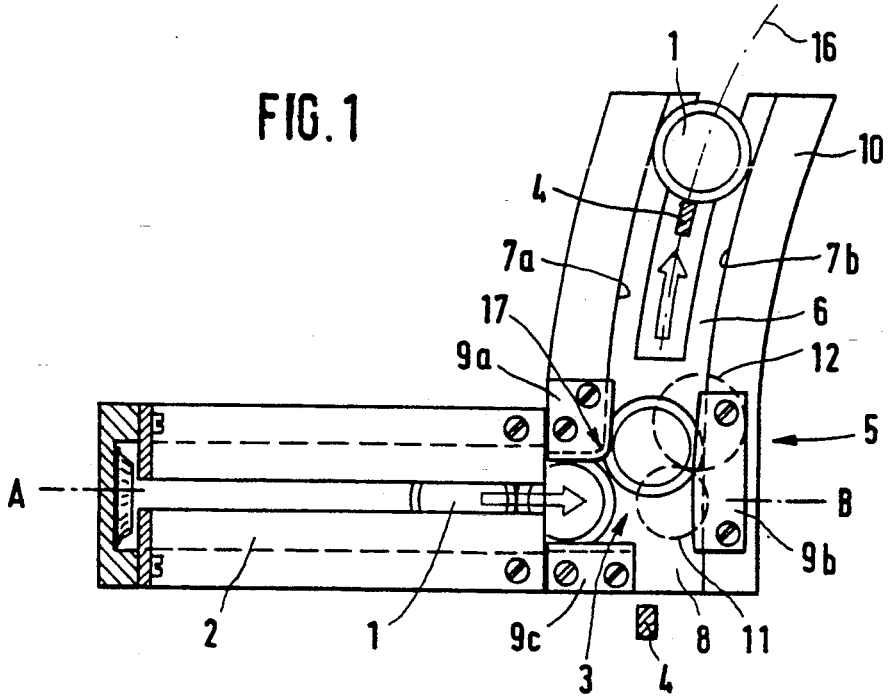
FIG. 1 is a top view on an apparatus for feeding closing caps in a vessel closing machine, with the closing heads of said apparatus being not shown.
Figure 2:
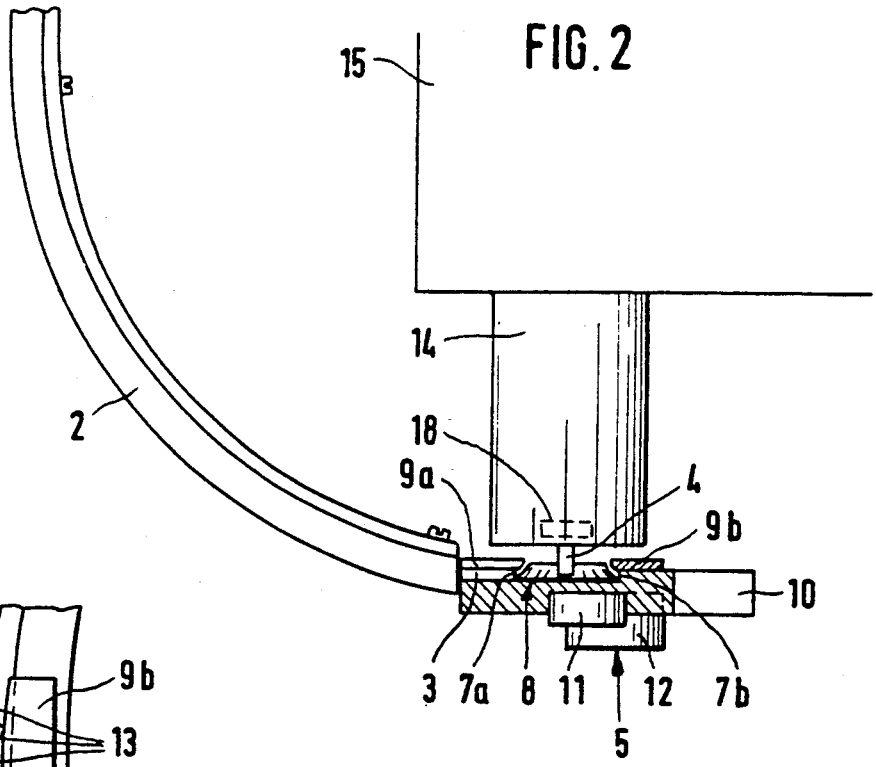
FIG. 2 shows section A–B of FIG. 1, with the closing heads being illustrated.

The apparatus illustrated in FIGS. 1 and 2 is integrated into a vessel closing machine (shown only in part), wherein closing caps 1 in the form of crown corks, hereinafter shortly called caps 1, are secured to beverage bottles (not shown). The apparatus comprises a conveying duct 2 which extends from a cap magazine (not shown) including stirring device and turn-over tube and which receives caps 1 in one row and side by side in the desired operative position with a slight play. Conveying duct 2 first extends in vertical direction and passes in its lower portion in curved fashion into an approximately horizontal plane. It includes an exactly horizontally extending end portion 3 which is formed in a metallic guide plate 10, whilst its remaining portion is formed by a U-shaped rail with screwed-on cover strips. Caps 1 are transported inside conveying duct 2 by gravitational force and, especially at a higher output, additionally by blow nozzles (not shown) at a high speed up to end portion 3, or rather the opening thereof.

End portion 3 of conveying duct 2 is immediately followed in the same horizontal plane by a guide channel 6 for caps 1. Like the channel-like end portion 3, guide channel 6 is molded into the horizontal guide plate 10 and has two lateral guide elements *7a*, *7b* for caps 1 in the form of vertical edges. The bottom of guide channel 6 is formed by a horizontal slide surface 8 which is provided on guide plate 10 and extends uninterruptedly into end portion 3 of conveying duct 2 and terminates at the U-shaped rail thereof.

As illustrated in FIG. 1, a plurality of cam-shaped engaging means 4 pass by, i.e., just before end portion 3 substantially at the level thereof in a direction transverse to the direction of movement of caps 1, as outlined by an arrow, in conveying duct 2. These engaging means are arranged on the bottom side of closing heads 14 which are adapted to be lifted and lowered in a controlled way and supported in a rotor 15 with a vertical rotational axis, and rotate together with these closing heads continuously along a curved path designated by 16 in the direction of the arrow.

Guide channel 6 together with its guide elements *7a*, *7b* seated at both sides of the curved path 16 is matched to the curved path 16 of engaging means 4 in such a way that the latter always engage caps 1 exactly in the center. As a consequence, guide channel 6 extends in its initial area almost at right angles to the end portion 3 of conveying duct 2 and extends in the rotational direction of engaging means 4. Guide element *7a* which is located at the side of conveying duct 2 passes via a slightly rounded portion 17 directly into the adjacent guide surface of end portion 3. By contrast, the other guide element *7b* extends beyond guide element *7a* against the rotational direction of engaging means 4 up into the space opposite to end portion 3 and forms a safety stop for the caps 1 exiting from conveying duct 2. To prevent caps 1 from rising in the transfer area between end portion 3 and guide channel 6, platelike holding-down devices *9a*, *9b*, *9c* which just overlap the edge of caps 1 with a play are screwed onto guide plate 10. Hence, there remains an adequate engagement space for engaging means 4, which sweep over slide surface 8 at a small distance.

The platelike holding-down devices *9a*, *9b*, *9c* may be adapted to the curvature and diameter of caps 1 in such a way that they assume the additional task to guide caps 1 laterally, i.e. either together with the guide elements of end portion 3 and guide elements *7a*, *7b* of guide channel 6, or also alone if these guide elements have a corresponding undercut. In such a case, one obtains an especially low-friction passage of the caps from conveying duct 2 into guide channel 6, and the wear on the guide elements is extremely small because these elements do not come into contact with the sharp edges of caps 1. A transfer means is provided for transferring closing caps 1 from the end portion 3 of conveying duct 2 to guide channel 6. As embodied, the transfer means comprises a transporting device 5 which consists of two permanent magnets 11 and 12 of different force in the transfer area of the caps 1 between the end portion 3 of conveying duct 2 and guide channel 6. Both permanent magnets 11, 12 are mounted on the bottom side of guide plate 10 at a small spacing from slide surface 8. The weaker permanent magnet 11 is exactly opposite to end portion 3, or rather the opening thereof. It is laterally followed in the transporting direction by the stronger permanent magnet 12 which is seated in the initial area of guide channel 6 slightly offset relative to the side of said channel facing away from conveying duct 2. Permanent magnet 12 has an attraction approximately twice the attraction of permanent magnet 11.

The respectively foremost cap 1 in the end portion 3 of conveying duct 2 is removed by transporting device 5 from said portion and moved around rounded portion 17 into guide channel 6 and between guide elements *7a*, *7b* thereof and holding-down devices *9a*, *9b*, i.e. over slightly more than half of its surface, so that it is guided in the area of its maximum width or diameter exactly between guide elements *7a*, *7b* and holding-down devices *9a*, *9b*, respectively. The magnetic force is adjusted such that cap 1 is retained in this position until it is carried along by the respective engaging means 4 and moved further through guide channel 6 in the direction of the arrow. At the same time, the immediately succeeding cap which is positioned in the end portion 3 of conveying duct 2 is kept outside the curved path 16 of engaging means 4 against the feeding force of caps 1 in conveying duct 2 due to the fixed cap 1. As soon as the fixed cap 1 has been removed by its engaging means 4, the next cap 1 moves up accordingly.

Figure 3:
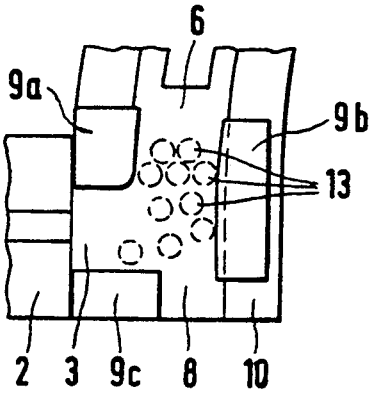
FIG. 3 is a partial top view similar to FIG. 1 with a modified transporting device for the closing caps.

The above-described function of the two permanent magnets 11, 12 can also be fulfilled by a multitude of smaller permanent magnets 13 of the same force provided that these are arranged in the way illustrated in FIG. 3, i.e. mounted just below slide surface 8 on guide plate 10.

Caps 1 which are pushed by engaging means 4 through guide channel 5 are subsequently seized by the permanent magnets 18 arranged on the lower front side of closing heads 14 and are then lowered together with closing heads 14 onto the beverage bottles to be closed and are there secured in the conventional way by bending.

We claim:

1. In a vessel closing apparatus having means for transporting closing caps to a vessel closing cap position in said vessel closing apparatus from a closing cap supply source, said closing caps having top, bottom and side surfaces, said transpiration means including a conveying chute for feeding said closing caps from said source to a discharge position at a discharge end of the chute in line and in side-by-side relationship and engaging mans moving in a path of travel adjacent the discharge end of the chute and transverse to the direction of discharge of said closing caps from said chute for engaging closing caps discharged from the chute and conveying them one at a time in said path to said vessel closing cap position, the improvement comprising a guide channel having a slide surface over which said closing caps can slide and a pair of spaced guide elements extending parallel to each other along opposite sides of said path of travel of the engaging means, said guide elements being spaced apart a distance slightly larger than the distance between opposite side surfaces of said closing caps, said guide channel having an entrance end adjacent the discharge end of said chute and guiding said closing caps for sliding movement only in said path of travel while they are being conveyed by the engaging means to the vessel closing cap position, and transfer means for transferring closing caps from the discharge position at the discharge end of the conveying chute one at a time to a holding position at least partly into said entrance end of the guide channel and between the guide elements thereof, said transfer means holding a closing cap in said holding position until the closing cap is engaged by the engaging means.

2. The apparatus of claim 1, wherein the discharge end of said conveying chute and the entrance end of said guide channel are in the same plane and are interconnected by a transfer slide surface.

3. The apparatus of claim 2, wherein said plane is horizontally arranged and hold down means are provided between the discharge end of said conveying chute and said guide channel for holding said caps on said transfer slide surface while they are being transferred by said transfer means.

4. The apparatus of claim 3, wherein said discharge end of said conveying chute, said guide channel, said transfer slide surface and said hold down means are part of a common guide plate.

5. The apparatus of claim 4, wherein said holddown means are lateral guides spaced vertically from said slide transfer surface that guide said caps as they enter said guide channel.

6. The apparatus of claim 1, wherein an end of the guide element of the guide channel closest to the discharge end of the conveying chute at the entrance end of the guide channel forms a rounded corner with a side wall of said conveying chute.

7. The apparatus of claim 1, wherein an end of the guide element of the guide channel farthest from the discharge end of the converging chute extends across and opposite from said discharge end forming a stop for closing caps discharged from said conveying chute.

8. The apparatus of claim 2, wherein said closing caps are of metal and said transfer means comprises at least one magnet.

9. The apparatus of claim 8, wherein said transfer means comprises two permanent magnets of different magnetic force, a magnet of weaker magnetic force being positioned opposite the discharge end of said conveying chute, and a magnet of stronger magnetic force at the entrance end of said guide channel, whereby said magnets, in combination, slide closing caps, one at a time, from the discharge position of the conveying chute along said transfer slide surface into said entrance end of the guide channel.

10. The apparatus of claim 8, wherein said transfer means comprises a multiple of permanent magnets of equal magnetic force, said magnets being arranged between the discharge end of said conveying chute and the entrance end of said guide channel with a greater concentration of said magnets nearer said entrance end, whereby said magnets, in combination, slide the closing caps, one at a time, from the discharge position of the conveying chute along said transfer slide surface into said entrance end of the guide channel.

11. The apparatus of claim 9 or 10, wherein said magnets are located beneath said transfer slide surface.

12. The apparatus of claim 1, wherein said engaging means engages a side of said closing caps while between said guide elements that extends in a plane at right angles relative to the sides of said closing caps guided by the guide elements of said guide channel.

13. The apparatus of claim 12, wherein the engaging means comprises a pin that moves along said path of travel and projects downwardly into said guide channel between said guide elements to engage a closing cap.

14. The apparatus of claim 1, wherein said holding position for said closing caps in said entrance end of the guide channel locates more than half of the closing cap between said guide elements of said guide channel prior to engagement by the engaging means.

* * * * *